US006350371B1

(12) United States Patent
Lokhandwala et al.

(10) Patent No.: US 6,350,371 B1
(45) Date of Patent: Feb. 26, 2002

(54) REFINERY PROCESS INCLUDING MEMBRANE SEPARATION

(75) Inventors: Kaaeid A. Lokhandwala, Union City; Richard W. Baker, Palo Alto, both of CA (US)

(73) Assignee: Membrane Technology and Research, Inc., Menlo Park, CA (US)

( * ) Notice: Subject to any disclaimer, the term of this patent is extended or adjusted under 35 U.S.C. 154(b) by 0 days.

(21) Appl. No.: 09/273,207

(22) Filed: Mar. 19, 1999

(51) Int. Cl.[7] ..... B01D 47/00

(52) U.S. Cl. ..... 208/134; 95/39; 95/41; 95/42; 95/50; 95/96; 95/149

(58) Field of Search ..... 208/134; 45/41, 45/42, 50, 96, 149

(56) References Cited

U.S. PATENT DOCUMENTS 4,425,222 A * 1/1984 Swan ..... 208/65
5,980,609 A * 11/1999 Baker et al. ..... 95/42

* cited by examiner

*Primary Examiner*—Helane E. Myers
(74) *Attorney, Agent, or Firm*—J. Farrant

(57) ABSTRACT

An improved process and process train for catalytic reforming of hydrocarbons. In its most simple form, the invention includes four unit operations or steps: the reforming itself usually carried out in a series of reactors; one or more steps to separate the reformate liquid product from overhead gases, predominantly $C_1$–$C_6$ hydrocarbons and hydrogen; one or more treatment steps to recover hydrogen from the overhead gases, and one or more treatment steps, including a membrane gas separation step, for the waste gas from the hydrogen recovery step. The process provides improved recovery of hydrogen and LPG, and reduces the amount of gas sent to the fuel line.

35 Claims, 3 Drawing Sheets

REFINERY PROCESS INCLUDING MEMBRANE SEPARATION

FIELD OF THE INVENTION

The invention relates to oil refinery operations, specifically to catalytic reforming of hydrocarbons, and more specifically to improved treatment of off-gases from the hydrocarbon reforming process.

BACKGROUND OF THE INVENTION

The reformer is the unit that provides the octane level needed for the gasoline product of the refinery. The reformer is also the principal hydrogen producer within the refinery, and an important aspect of reformer operation is to generate as much hydrogen as possible, consistent with other requirements, of a quality suitable for use in the hydrogen-consuming units, particularly hydrocrackers and hydrotreaters.

The reformer feedstock is straight run naphtha or a naphtha cut from other refinery operations, such as coker naphtha or FCC (fluid catalytic cracking) naphtha. Although the bulk of components in straight run naphtha are paraffins, also present may be naphthenes, aromatics and olefins; non-virgin naphtha stocks tend to be higher in aromatics and olefins. Reforming involves the upgrading of these components to components of higher research octane number (RON) by various reactions. The process is generally carried out in three reaction zones, in each of which specific reactions are favored. For example, the first zone may perform, among other reactions, dehydrogenation of methylcyclohexane to toluene (RON 120), the second zone may perform dehydrocyclization of iso-heptane to toluene, and the third zone may perform isomerization of normal to iso-heptane (RON 90), as well as cracking of n-heptane to pentane (RON 90). Although the process is an overall producer of hydrogen, hydrogen is recycled back to the feed to maintain the hydrogen-to-hydrocarbon ratio in the reactors within a range to favor the desired reactions and to prolong the catalyst life. Typically hydrogen:hydrocarbon molar ratios up to about 10:1 are used.

In an ideal situation, no cracking that results in light hydrocarbons would take place, and the only by-product of the reactions would be hydrogen. In practice, this cannot be achieved. Conversion of iso-heptane to toluene and of methylcyclohexane to toluene are both hydrogen-producing reactions, but the cracking reactions result in formation of light hydrocarbon fragments, such as methane, ethane, propane and butanes. These light hydrocarbons contaminate the hydrogen product and may result in over-production of fuel gas. Under some reforming conditions, even more undesirable side reactions can give rise to formation of polycyclic aromatic compounds, some of which can be carried into the recycle gas. The net result is that, in an average refinery, 20,000 bbl of straight run naphtha feedstock may be converted into about 15,000 bbl of reformate and 5,000 bbl of gas, which includes substantial amounts of $C_1$–$C_5$ hydrocarbons.

The gaseous effluent from the reactor series is cooled and separated into liquid and vapor phases. The phase separation into liquid and vapor portions is often carried out in one or more steps by simply changing the pressure and/or temperature of the effluent. Therefore, in addition to hydrogen, the overhead vapor from the phase separation usually contains light hydrocarbons, specifically methane and ethane. In a closed recycle loop, these components build up, change the reactor equilibrium conditions, and can lead to reduced product yield. This build-up of undesirable contaminants is usually controlled by purging a part of the vapor stream from the loop. Such a purge operation is unselective however, and, since the purge stream may contain as much as 80 vol % or more hydrogen, multiple volumes of hydrogen can be lost from the loop for every volume of contaminant that is purged.

Since the reformer is a net hydrogen producer, the overhead vapor is typically split into at least two portions, one for recycle in the reactor loop, the other that forms a purge from the loop and that is frequently submitted to additional separation and treatment, such as by adsorption of the hydrocarbons. This creates a net hydrogen stream of a relatively high hydrogen concentration, such as 80%, 90% or above, for use elsewhere in the refinery, and a waste hydrocarbon stream to be sent for light ends recovery or to the fuel header. Use of pressure swing adsorption (ISA) for this upgrading step is known in the art and is taught, for example, in U.S. Pat. No. 5,332,492, in which tail gas is returned to the contactor section of the phase-separation steps, and U.S. Pat. No. 5,278,344, in which PSA is used to purify the net hydrogen stream after catalytic reforming and in front of a hydrodealkylation step.

It is also known to use membrane separation for removing hydrogen from hydrocarbons in refinery gas streams from various sources. U.S. Pat. Nos. 4,362,613, and 4,367,135, both to Monsanto, describe processes for treating the vapor from phase separators in a hydrocracking plant by passing the vapor across a membrane that is selectively permeable to hydrogen. The process yields a hydrogen-enriched permeate that can be recompressed and recirculated to the reactor. U.S. Pat. No. 5 4,548,619, to UOP, shows membrane treatment of the overhead gas from an absorber treating effluent from benzene production. The membrane again permeates the hydrogen selectively and produces a hydrogen-enriched gas product that is withdrawn from the process. U.S. Pat. No. 5,053,067, to L'Air Liquide, discloses removal of part of the hydrogen from a refinery off-gas to change the dewpoint of the gas to facilitate downstream treatment. U.S. Pat. No. 5,082,481, to Lummus Crest, describes removal of carbon dioxide, hydrogen and water vapor from cracking effluent, the hydrogen separation being accomplished by a hydrogen-selective membrane. U.S. Pat. No. 5,157,200, to Institut Francais du Petrole, shows treatment of light ends containing hydrogen and hydrocarbons, including using a hydrogen-selective membrane to separate hydrogen from other components. U.S. Pat. No. 5,689,032, to Krause/Pasadyn, discusses a method for separating hydrogen is and hydrocarbons from refinery off-gases, including multiple low-temperature condensation steps and a membrane separation step for hydrogen removal.

The use of certain polymeric membranes to treat off-gas streams in refineries is also described in the following papers: "Prism™ Separators Optimize Hydrocracker Hydrogen", by W. A. Bollinger et al., presented at the AICHE 1983 Summer National Meeting, August 1983; and "Optimizing Hydrocracker Hydrogen" by W. A. Bollinger et al., in Chemical Engineering Progress, May 1984. The use of membranes in refinery separations is also mentioned in "Hydrogen Technologies to Meet Refiners' Future Needs", by J. M. Abrardo et al. in Hydrocarbon Processing, February 1995. This paper points out the disadvantage of membranes, namely that they permeate the hydrogen, thereby delivering it at low pressure, and that they are susceptible to damage by hydrogen sulfide and heavy hydrocarbons. Papers that specifically concern treatment of reformer off-gases are "Hydrogen Purification with Cellulose Acetate Membranes", by H. Yamashiro et al., presented at the Europe-Japan Congress on Membranes and Membrane Processes, June 1984; and "Plant Uses Membrane Separation", by H. Yamashiro et al., in Hydrocarbon Processing, February 1985. In these papers, a system and process using membranes to treat the overhead gas stream from the absorber/recontactor section of the plant are described. All of these papers describe system designs using cellulose acetate or similar membranes that permeate hydrogen and reject hydrocarbons.

A chapter in "Polymeric Gas Separation Membranes", D. R. Paul et al. (Eds.) entitled "Commercial and Practical Aspects of Gas Separation Membranes", by Jay Henis describes various hydrogen separations that can be performed with hydrogen-selective membranes.

Literature from Membrane Associates Ltd., of Reading, England, shows and describes a design for pooling and downstream treating various refinery off-gases, including passing of the membrane permeate stream to subsequent treatment for LPG recovery.

Other references that describe membrane-based separation of hydrogen from gas streams in a general way include U.S. Pat. Nos. 4,654,063 and 4,836,833, to Air Products and Chemicals, and U.S. Pat. No. 4,892,564, to Cooley. U.S. Pat. No. 4,857,078, to Watler, mentions that, in natural gas liquids recovery, streams that are enriched in hydrogen can be produced as retentate by a rubbery membrane.

It has also been recognized that condensation and membrane separation may be combined, as is shown in U.S. Pat. Nos. 5,089,033; 5,199,962; 5,205,843 and 5,374,300.

Numerous patents describe combinations of membrane separation with PSA. Representative examples include U.S. Pat. Nos. 4,229,188; 4,238,204; 4,398,926; 4,690,695; 4,701,187; and 4,783,203. U.S. Pat. No. 5,332,424, to Air Products and Chemicals, describes fractionation of a gas stream containing hydrocarbons and hydrogen using an "adsorbent membrane". The membrane is made of carbon, and selectively adsorbs hydrocarbons onto the carbon surface, allowing separation between various hydrocarbon fractions to be made. Hydrogen tends to be retained in the membrane residue stream. Optionally, the membrane separation step is followed by PSA treatment. Other Air Products patents that show application of carbon adsorbent membranes to hydrogen/hydrocarbon separations include U.S. Pat. Nos. 5,354,547; 5,447,559; and 5,507,856, which all show combinations of carbon adsorbent membranes followed by PSA. U.S. Pat. No. 5,634,354 discloses removal of hydrogen from hydrogen/olefin streams. In this case, the membrane used to perform the separation is either a polymeric membrane selective for hydrogen over hydrocarbons or a carbon adsorbent membrane selective for hydrocarbons over hydrogen.

U.S. Pat. No. 5,435,836, concerns treatment of mixtures of hydrogen, carbon dioxide, carbon monoxide and methane from steam reformers. The gas mixture from the steam reformer is treated by PSA to recover a high purity hydrogen stream. The waste gas from the PSA unit is then treated by membrane separation using a carbon adsorbent membrane. The hydrogen-rich residue is returned to the PSA unit and the permeate gas from the membrane unit can optionally be used as fuel for the steam reformer. U.S. Pat. No. 5,753,010 discloses a process similar to that of U.S. Pat. No. 5,435,836, but in which the tail gas from the PSA unit is split into two fractions of unlike composition, which are treated separately in two discrete membrane steps.

U.S. Pat. No. 6,190,536 describes treatment of off-gases form fluid catalytic cracking absorbers using hydrocarbon-selective membranes.

U.S. Pat. No. 6,171,472 describes treatment of overhead gases in hydrocarbon conversion reactors of any type by passing gases in the reactor recycle loop across hydrocarbon-selective membranes. U.S. Pat. No. 6,190,540 describes such a process applied specifically to hydrotreaters and hydrocrackers.

U.S. Pat. No. 6,011,192 describes a process in which a rubbery polymeric membrane is used to condition a gas stream to remove heavy hydrocarbons before PSA treatment.

U.S. Pat. No. 6,165,350 describes the use of hydrogen-rejecting membranes to directly treat overhead gases from the phase separators of catalytic reformers.

SUMMARY OF THE INVENTION

The invention is an improved process and process train for catalytic reforming of hydrocarbons. In its most simple form, the invention includes four unit operations or steps: the reforming itself, usually carried out in a series of reactors; one or more steps to separate the reformate liquid product from overhead lighter components, predominantly $C_1$–$C_6$ hydrocarbons and hydrogen; one or more treatment steps to recover hydrogen from the overhead gases, and one or more treatment steps for the waste gas from the hydrogen recovery step. The invention also includes an improved catalytic reformer apparatus, comprising the reactor itself, the phase separation equipment, and equipment to treat the net gas produced by the reactors, this equipment including at least two different treatment units, the second of which is a membrane separation unit containing a polymeric membrane that is selective for $C_1$–$C_6$ hydrocarbons over hydrogen, and that treats the non-product gas from the first unit.

The catalytic reforming itself may be performed in any manner and using any types of reactors, catalysts and operating schemes known in the art. The separation step into liquid and overhead gas phases is typically, although not necessarily, carried out by first cooling the reactor effluent, producing a raw reformate liquid fraction, and a first overhead gas fraction, part of which is generally returned to the reforming reactors. This step may be followed by recontact of portions of the raw liquid and overhead gas phases at a lower temperature to promote additional absorption of heavier components into the liquid phase and partitioning of hydrogen and light gases into the gas phase. The treatment step for the remaining overhead gas, which is the source of net hydrogen produced by the reformer, involves separating the hydrogen from the hydrocarbons, and usually includes an adsorption step, typically by pressure-swing adsorption. The treatment steps for the waste gases produced when the adsorption beds are regenerated include compression/cooling, which may optionally result in the formation of an additional liquid fraction, and membrane separation using a polymeric membrane that is selective in favor of hydrocarbons over hydrogen.

In a basic embodiment, these steps take the following form:

(a) catalytically reforming a hydrocarbon feedstock in a reactor system;

(b) withdrawing an effluent stream comprising hydrogen and hydrocarbons from the reactor system;

(c) separating a reformate liquid phase and a vapor phase, comprising hydrogen and $C_1$–$C_6$ hydrocarbons, from the effluent stream;

(d) recirculating a portion of the vapor phase to the reactor system;

(e) passing at least a portion of the unrecirculated vapor phase through at least one treatment step, including an adsorption step carried out in an adsorption system, to separate hydrogen from the $C_1$–$C_6$ hydrocarbons;

(f) withdrawing a purified hydrogen product stream from the adsorption step;

(g) withdrawing a waste hydrocarbon stream from the adsorption system;

(h) compressing and cooling the waste hydrocarbon stream;

(i) passing at least a portion of the compressed, cooled waste hydrocarbon stream as a feed stream across the feed side of a polymeric membrane having a feed side and permeate side, and being selective for $C_1$–$C_6$ hydrocarbons over hydrogen;

(j) withdrawing from the feed side a residue stream enriched in hydrogen compared with the waste hydrocarbon stream;

(k) withdrawing from the permeate side a permeate stream enriched in $C_1$–$C_6$ hydrocarbons compared with the waste hydrocarbon stream.

Preferred embodiments include returning the hydrogen-rich stream from the membrane separation to the adsorption step, thereby increasing the amount of net hydrogen produced by the reformer. Preferred embodiments also include operating the compression/cooling step at pressure temperature combinations sufficient to liquefy the heavier of the hydrocarbon components present in the waste gas stream from the adsorption unit, thereby providing an additional LPG product stream.

A particularly preferred embodiment, therefore, takes the following form:

(a) catalytically reforming a hydrocarbon feedstock in a reactor system;

(b) withdrawing an effluent stream comprising hydrogen and hydrocarbons from the reactor system;

(c) separating a raw reformate liquid phase and a vapor phase, comprising hydrogen and $C_1$–$C_6$ hydrocarbons, from the effluent stream;

(d) recirculating a portion of the vapor phase to the reactor system;

(e) passing at least a portion of the unrecirculated vapor phase and at least a portion of the raw reformate liquid into a contactor;

(f) withdrawing from the contactor a gas stream depleted in $C_3$+hydrocarbon content compared with the unrecirculated vapor phase;

(g) passing at least a portion of the gas stream through an adsorption step carried out in an adsorption system, to separate hydrogen from $C_1$–$C_6$ hydrocarbons;

(h) withdrawing a purified hydrogen product stream from the adsorption step;

(i) withdrawing a waste hydrocarbon stream from the adsorption system;

(j) compressing and cooling the waste hydrocarbon stream, thereby forming a condensate and an uncondensed portion;

(k) passing at least a portion of the uncondensed portion as a feed stream across the feed side of a polymeric membrane having a feed side and permeate side, and being selective for $C_1$–$C_6$ hydrocarbons over hydrogen;

(l) withdrawing from the feed side a residue stream enriched in hydrogen compared with the waste hydrocarbon stream;

(m) withdrawing from the permeate side a permeate stream enriched in the $C_1$–$C_6$ hydrocarbons compared with the waste hydrocarbon stream;

(n) recirculating at least a portion of the residue stream to the adsorption step.

Optionally, the hydrogen-rich stream from the membrane separation operation may be sent to a membrane purge step. This provides additional separation between the remaining light hydrocarbons and hydrogen, and enables $C_1$ and $C_2$ hydrocarbons to be purged from the reformer train with lower hydrogen loss than otherwise. In this aspect, the invention includes the following steps:

(a) catalytically reforming a hydrocarbon feedstock in a reactor system;

(b) withdrawing an effluent stream comprising hydrogen and hydrocarbons from the reactor system;

(c) separating a reformate liquid phase and a vapor phase, comprising hydrogen and the $C_1$–$C_6$ hydrocarbons, from the effluent stream;

(d) recirculating a portion of the vapor phase to the reactor system;

(e) passing at least a portion of the unrecirculated vapor phase through at least one treatment step, including an adsorption step carried out in an adsorption system, to separate hydrogen from the $C_1$–$C_6$ hydrocarbons;

(f) withdrawing a purified hydrogen product stream from the adsorption step;

(g) withdrawing a waste hydrocarbon stream from the adsorption system;

(h) compressing and cooling the waste hydrocarbon stream;

(i) passing at least a portion of the compressed, cooled waste hydrocarbon stream as a feed stream across the feed side of a polymeric membrane having a feed side and permeate side, and being selective for $C_1$–$C_6$ hydrocarbons over hydrogen;

(j) withdrawing from the permeate side a permeate stream enriched in $C_1$–$C_6$ hydrocarbons compared with the waste hydrocarbon stream;

(k) withdrawing from the feed side a residue stream enriched in hydrogen compared with the waste hydrocarbon stream;

(l) subjecting at least a portion of the residue stream to a membrane purge step, thereby forming a hydrogen-enriched stream and a light-hydrocarbon-enriched stream;

(m) purging the light-hydrocarbon-enriched stream from the process; and optionally, (n) recirculating at least a portion of the hydrogen-enriched stream to the adsorption step.

In yet another aspect, the invention is an improved catalytic reformer train, including the reforming reactor, liquid/vapor phase separators, an adsorption system, and a membrane separation system including a compression/cooling unit and a membrane unit.

The invention has a number of advantages, including but not limited to:

increased hydrogen production compared with prior art techniques production of a discrete LPG stream ability to debottleneck plants where fuel gas production is at maximum preparation of feed streams for steam reforming.

Polymeric materials are used for the membranes. This renders the membranes easy and inexpensive to prepare and to house in modules, by conventional industrial techniques, unlike other types of hydrogen-rejecting membranes, such as finely microporous inorganic membranes, including adsorbent carbon membranes, pyrolysed carbon membranes and ceramic membranes, which are difficult and costly to fabricate in industrially useful quantities.

The use of hydrocarbon-selective, hydrogen-rejecting polymeric membranes means that the hydrogen-enriched stream is retained on the feed side of the membrane. In other words, the hydrogen-enriched stream withdrawn from the membrane separation unit remains at pressure, which is desirable for recycle to the adsorption unit, as well as for facilitating delivery to most other destinations.

DETAILED DESCRIPTION OF THE INVENTION

The terms gas and vapor are used interchangeably herein.

The term $C_{2-}$ hydrocarbon means a hydrocarbon having at least two carbon atoms; the term $C_{3-}$ hydrocarbon means a hydrocarbon having at least three carbon atoms; and so on.

The term $C_{2-}$ hydrocarbon means a hydrocarbon having no more than two carbon atoms; the term $C_{3-}$ hydrocarbon means a hydrocarbon having no more than three carbon atoms; and so on.

The term light hydrocarbon means a $C_1$ or $C_2$ hydrocarbon.

The term heavier hydrocarbons means $C_{3-}$ hydrocarbons.

Percentages herein are by volume unless otherwise stated.

The invention is an improved process and apparatus train for catalytic reforming of hydrocarbons. The goals of the process are to form a reformate liquid for addition to the gasoline pool, to produce a net hydrogen stream of purity suitable for use as a feedstock elsewhere in the refinery, and optionally to provide an LPG product stream. Other goals that may be pertinent in specific circumstances are to reduce the amount of fuel gas generated by the reforming train, and to provide a steam reformer feedstock.

The process can be applied to any catalytic reformer train. In a basic aspect, the invention is a process that includes reforming a hydrocarbon feedstock in a reactor, thereby forming hydrocarbons of higher octane number, separating the effluent from the reactor into liquid reformate and vapor portions, purging at least some of the vapor portion from the reactor loop, and treating this portion to separately recover one, two or more discrete products. In another aspect, the invention is apparatus for carrying out the process.

Figure 1:
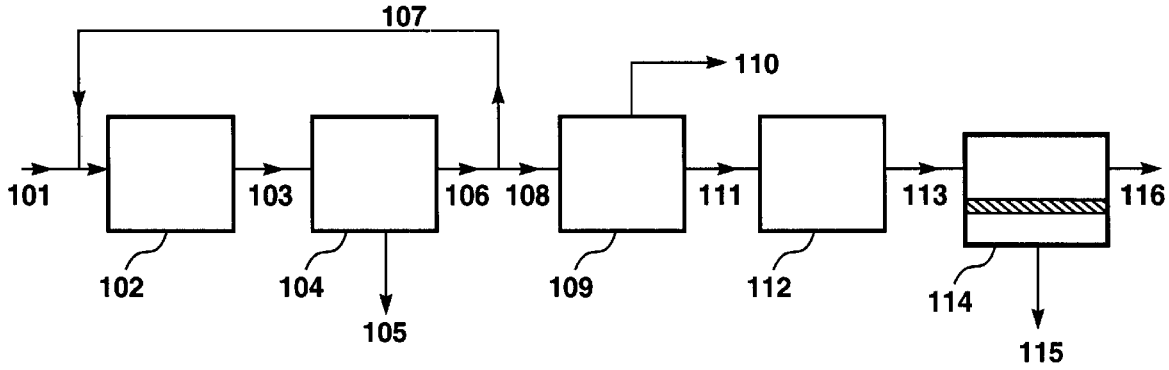
FIG. 1 is a schematic drawing showing a basic embodiment of the invention.

The invention in aspects of this type is shown schematically in FIG. 1. It will be appreciated by those of skill in the art that this and the other figures described below are very simple schematic diagrams, intended to make clear the key aspects of the invention, and that an actual process train will usually include many additional components of a standard type, such as compressors, heaters, chillers, condensers, pumps, blowers, other types of separation and/or fractionation equipment, valves, switches, controllers, pressure-, temperature-, level- and flow-measuring devices and the like. Referring to this figure, box 102 represents the reactor, which may be of any type. Catalytic reforming reactors are well known in the art and do not require any lengthy description herein. A reference that provides discussion of design and operation of modern reformers is Chapter 4 of "Handbook of Petroleum Refining Processes" Second Edition, R. A. Meyers (Ed), McGraw Hill, 1997. In general, three categories of reactor are in use. The oldest, which still account for more than half of current working reactors, are known as semi-regenerative systems. These systems contain three or four reactor vessels with fixed catalyst beds. The reactors are run for a period of typically 6–12 months, then taken off-line for catalyst regeneration. As the on-stream time progresses, the reactor temperature is increased to maintain operating severity. Nevertheless, the reformate yield and hydrogen purity tend to drop slightly over time. The gas from these reactors usually has a hydrogen content of about 75–80%.

The second category is cyclic or swing reactors. These systems contain a chain of fixed-bed reactors that can be switched in and out of service for regeneration independently as needed, so that the system as a whole remains on-line continuously. Cyclic reactors have the potential to produce both higher octane reformate and more hydrogen than semi-regenerative reactors but are more costly and complicated.

The third category of reformer is the continuous catalyst regeneration (CCR) system. In these systems, the multiple reactor stages are mounted together in a vertical stack, and the catalyst forms a moving bed that gradually travels down through the reactor stages, through a regenerator and back to the top of the reactor over a period of up to a week. Hybrid combinations of the individual system types are also possible.

FIG. 1 shows two feed streams, 101, the hydrocarbon charge and 107, the recycle stream entering the reactor, 102. Very commonly, the streams will be combined as shown and passed through compressors, heat exchangers or direct-fired heaters (not shown) to bring them to the appropriate reaction conditions before entering the reactors. Alternatively, the streams can be prepared and fed separately to the reactor. Commonly, the hydrocarbon stream, 101, itself may be a combination of recycled unreacted hydrocarbons and fresh feed.

As mentioned above, one or multiple reactors may be involved in the process, with the individual reactors carrying out the same or different unit operations. The reactor operating conditions are not critical to the invention and can and will vary depending on the type and specific operating constraints of the reactor. For example, a CCR system may operate at comparatively high temperature, such as 550° C., and low pressure, such as below 250 psig, whereas a semi-regenerative system may operate at comparatively low temperature, such as 420° C., and high pressure, such as above 500 psig. Thus, the invention embraces all reactor temperature and pressure conditions, although it is expected that these will generally be in the range 300–550° C. and 50–1,000 psig respectively. The reactors can carry out any of the reforming reactions recognized in the art.

The effluent stream, 103, is withdrawn from the reactor. The first treatment step required is to separate the stream into discrete liquid and gas phases, shown as streams 105 (liquid) and 106 15 (vapor) in FIG. 1. This separation step is indicated simply as box 104, although it will be appreciated that it can be executed in one step or in multiple similar or dissimilar sub-steps. For example, the effluent from a reformer may be at 500° C. and may be reduced in temperature in three stages to 50° C. The cooling step or steps may be performed by heat exchange against other plant streams, such as the hydrogen and hydrocarbon streams incoming to the reactor and/or by using air cooling, water cooling or refrigerants, depending on availability and the desired final temperature. As another example, and as is discussed in more detail below with respect to FIG. 2, frequently the effluent is cooled in a first phase-separation step, then parts of the resulting vapor and liquid are cooled further and recontracted in a second partitioning step. Such techniques are familiar to those of skill in the art. The physical nature of the separator vessels can be chosen from simple gravity separators, cyclone separators or any other convenient type.

The raw reformate liquid stream, 105, is withdrawn and passed to downstream treatment in preparation for addition to the gasoline pool. Such treatments, include, but are not limited to, stabilization to remove light ends and LPG, and fractionation, and are familiar to those of skill in the art.

The vapor phase, the principal constituent of which is usually hydrogen, but which also contains substantial amounts of $C_1$–$C_6$ hydrocarbons, is withdrawn as stream 106, and is divided into two portions: 107, which is returned to the reformer to maintain the hydrogen ratio therein at an appropriate level, and 108, the net gas stream, which is purged from the reformer reactor loop. Stream 108 passes to treatment step 109. The goal of this step is to provide a supply of hydrogen, typically, but not necessarily, of better than 99% purity, for use in other refinery operations, such as hydrotreating or hydrocracking, or elsewhere. This stream of net hydrogen product is shown as stream 110. The treatment step may be carried out in one operation or in a series of similar or dissimilar substeps, using any techniques known in the art. A preferred technique is selective adsorption, such as pressure swing adsorption (PSA), in which the hydrocarbons are adsorbed onto the adsorbent bed, leaving a purified hydrogen stream that is withdrawn as a product from the process. At intervals, the bed is regenerated and a waste hydrocarbon stream is removed.

PSA and other selective adsorption systems usually comprise a series of beds of a zeolite or similar material that will selectively sorb one or more components of the gas mixture. The beds are connected in such a way that each bed can be switched periodically from adsorption mode to regeneration mode. As one bed or set of beds is taken off-line for regeneration, another bed or set of beds is switched in so that gas can be processed continuously. In the sorption mode, which is typically carried out at elevated pressure, typically above 150 psia, such as 200 psia, 300 psia, 500 psia or above, hydrocarbons are adsorbed onto the active beds. In the present invention, the adsorption step is carried out preferably at a pressure no higher than about 750 psia, and more preferably in the range 50–500 psia. The gas exiting the bed, stream 110, typically has a very high hydrogen content, such as 99 vol % hydrogen or higher.

When the adsorbing beds have been charged to the desired level, they are switched into desorption/regeneration mode. The desorption/regeneration step can be carried out by any convenient techniques known in the art. Such techniques include, but are not limited to, passing a displacement gas concurrently through the bed to sweep out unadsorbed gas from the void spaces, concurrent depressurization of the bed to position the mass transfer front appropriately, countercurrent depressurization to remove previously adsorbed gas, and countercurrent purging to complete regeneration of the bed for reuse.

Depressurization of the bed during these steps may take place by multiple reductions in pressure, as is known in the art, and may reduce the pressure to atmospheric pressure (15 psia) or below. Removal of void space gas and positioning of the mass transfer front is preferably carried out, however, at a pressure in the range 50–250 psia, and countercurrent desorption is preferably carried out at a pressure no lower than 15 psia, more preferably in the range 15–75 psia, yet more preferably no lower than about 30 psia and most preferably no lower than about 50 psia.

By way of non-limiting example, a typical bed cycle may be: (i) adsorption at 500 psia; (ii) depressurization to 200 psia under concurrent flow conditions; (iii) depressurization to 50 psia under countercurrent flow conditions; (iv) purging at 50 psia; (v) repressurization.

The gases that are removed during the desorption/regeneration steps are shown generally in FIG. 1 as stream 111. In practice, several streams of different compositions will be produced during the individual parts of the regeneration cycle. It is within the scope of the invention to treat only one of these streams, or some other portion of the total, in the remaining steps 112 and 114, but is preferred to treat all of the waste gas, or tail gas, as shown in FIG. 1.

In the aggregate, stream 111 has a typical composition of about 40%, 50% or 60% hydrogen and 60%, 50% or 40% mixed $C_1$–$C_6$ hydrocarbons. This stream is passed to compression/cooling step 112. This raises the gas pressure from the comparatively low pressure at which it emerges from the PSA unit to a higher pressure, such as 100 psia, 300 psia, 500 psia, 700 psia or more to facilitate the subsequent membrane separation step and downstream recycle or treatment. Preferably, this pressure is in the range 150–750 psia, and most preferably in the range about 300–400 psia. Any type of compressor may be used, and the desired pressure may be reached in one or multiple stages.

The degree of cooling to which the gas is then subjected may be chosen based on the gas composition, the temperature at which it is desired to operate the subsequent membrane separation step, and whether a liquid hydrocarbon product is required from this step. In general, for polymeric hydrocarbon-selective membranes, separation performance is enhanced as operating temperature drops. Thus, it is preferred that the gas stream 113 leaving the compression/cooling train be at a temperature no higher than about 20° C., and it is most preferred that the stream be substantially colder, such as 0° C. or below, down to about −25° C. or 40° C. The temperature can be reached in any manner, including, but not limited to, simple air aftercooling of the compressor outlet gases, heat exchange against other streams, such as the streams entering or leaving the membrane unit, chilling by external refrigerants, and any combinations of these. Such methods are familiar to those of skill in the art. The compression/cooling step may or may not result in condensation of a liquid hydrocarbon fraction, depending on the combined pressurettemperature conditions to which the gas is subjected. A representative embodiment that includes condensation is discussed with respect to FIG. 2 below.

Gas stream 113 leaves the compression/cooling step and passes to membrane separation step 114. The permeability of a gas or vapor through a membrane is a product of the diffusion coefficient, D, and the Henry's law sorption coefficient, k. D is a measure of the permeant's mobility in the polymer; k is a measure of the permeant's sorption into the polymer. The diffusion coefficient tends to decrease as the molecular size of the permeant increases, because large molecules interact with more segments of the polymer chains and are thus less mobile. The sorption coefficient depends, amongst other factors, on the condensability of the gas.

Depending on the nature of the polymer, either the diffusion or the sorption component of the permeability may dominate. In rigid, glassy polymer materials, the diffusion coefficient tends to be the controlling factor and the ability of molecules to permeate is very size dependent. As a result, glassy membranes tend to permeate small, low-boiling molecules, such as hydrogen and methane, faster than larger, more condensable molecules, such as $C_{3+}$ organic molecules. For rubbery or elastomeric polymers, the difference in size is much less critical, because the polymer chains can be flexed, and sorption effects generally dominate the permeability. Elastomeric materials, therefore, tend to permeate larger, condensable molecules faster than small, low-boiling molecules. Thus, most rubbery materials are selective in favor of all $C_{3+}$ hydrocarbons over hydrogen, and can be used in the invention. Examples of polymers that can be used to make such elastomeric membranes, include, but are not limited to, nitrile rubber, neoprene, polydimethylsiloxane (silicone rubber), chlorosulfonated polyethylene, polysilicone-carbonate copolymers, fluoroelastomers, plasticized polyvinylchloride, polyurethane, cis-polybutadiene, cis-polyisoprene, poly(butene-1), polystyrene-butadiene copolymers, styrenetbutadiene/styrene block copolymers, styrene/ethylene/butylene block copolymers, and thermoplastic polyolefin elastomers.

For the smallest, least condensable hydrocarbons, methane in particular, even rubbery polymers tend to be selective in favor of hydrogen, because of the relative ease with which the hydrogen molecule can diffuse through most materials. For example, neoprene rubber has a selectivity for hydrogen over methane of about 4, natural rubber a selectivity for hydrogen over methane of about 1.6, and Kraton, a commercial polystyrene-butadiene copolymer, has a selectivity for hydrogen over methane of about 2. Therefore, although any of the rubbery membrane materials mentioned above are usefull in the invention for providing separation of hydrocarbons from hydrogen, the most preferred membrane materials are more permeable to all hydrocarbons, including methane, than to hydrogen. To applicants' knowledge, among the polymeric membranes that perform gas separation based on the solution/diffusion mechanism, silicone rubber and closely related polymers are the only materials that are selective in favor of methane over hydrogen, and thus are most preferred. Other materials that might perhaps be found by appropriate experimentation to be methane/hydrogen selective include other polysiloxanes. Also, U.S. Pat. No. 4,370,150 cites data for silicone-polycarbonate copolymer membranes that suggest a pure gas selectivity of about 1.3 for methane over hydrogen, but this would, of course, depend on the exact composition of the polymer and the other components of an actual gas.

Another class of polymer materials that has at least a few members that should be methane/hydrogen selective, at least in multicomponent mixtures including other more condensable hydrocarbons, is the superglassy polymers, such as poly(1-trimethylsilyl-1-propyne) [PTMSP] and poly (4methyl-2-pentyne) [PMP]. These differ from other polymeric membranes in that they do not separate component gases by solution/diffision through the polymer. Rather, gas transport is believed to occur based on preferential sorption and diffusion on the surfaces of interconnected, comparatively long-lasting free-volume elements. Membranes and modules made from these polymers are less well developed to date; this class of materials is, therefore, less preferred than silicone rubber.

The membrane may take any convenient form known in the art. The preferred form is a composite membrane including a microporous support layer for mechanical strength and a silicone rubber coating layer that is responsible for the separation properties. Additional layers may be included in the structure as desired, such as to provide strength, protect the selective layer from abrasion, and so on.

The membranes may be manufactured as flat sheets or as fibers and housed in any convenient module form, including spiral-wound modules, plate-and-frame modules and potted hollow-fiber modules. The making of all these types of membranes and modules is well known in the art. Flat-sheet membranes in spiral-wound modules are our most preferred choice. Since conventional polymeric materials are used for the membranes, they are relatively easy and inexpensive to prepare and to house in modules, compared with other types of membranes that might be used as hydrogen-rejecting membranes, such as finely microporous inorganic membranes, including adsorbent carbon membranes, pyrolysed carbon membranes and ceramic membranes.

To achieve a high transmembrane hydrocarbon flux, the selective layer responsible for the separation properties should be thin, preferably, but not necessarily, no more than 30 $\mu$m thick, more preferably no more than 20 $\mu$m thick, and most preferably no more than 5 $\mu$m thick. If superglassy materials are used, their permeabilities are so high that thicker membranes are possible.

A driving force for transmembrane permeation is provided by a pressure difference between the feed and permeate sides of the membrane. As mentioned above, the membrane separation step is generally requires a higher pressure on the feed side than the pressure at which the gas leaves the PSA unit, so the gas is usually compressed to a few hundred psi before entering the membrane unit. The pressure on the permeate side may be atmospheric, or may be maintained at an above-atmospheric or below-atmospheric pressure convenient with respect to the destination of the permeate stream. As a general guide, a pressure ratio (feed pressurelpermeate pressure) of at least about four or five is preferred.

Depending on the composition of the membrane feed stream 113, a single-stage membrane separation operation may be adequate to produce a permeate stream with an acceptably high contaminant content and low hydrogen content If the permeate stream requires furter separation, it may be passed to a second bank of modules for a second-stage treatment. If the second permeate stream requires fixer purification, it may be passed to a third bank of modules for a third processing step, and so on. Likewise, if the residue stream requires firther contaminant removal, it may be passed to a second bank of modules for a second-step treatment, and so on. Such multistage or multistep processes, and variants thereof, will be familiar to those of skill in the art, who will appreciate that the membrane separation step may be configured in many possible ways, including single-stage, multistage, multistep, or more complicated arrays of two or more units in series or cascade arrangements. Representative embodiments of a few of such arrangements are given in U.S. Pat. No. 6,171,472, entitled "Selective Purge for Reactor Recycle Loop".

By selectively removing the non-hydrogen components, the membrane separation step results in a membrane residue stream, 116, that is enriched in hydrogen compared with the membrane feed stream 113. Typically, but not necessarily, stream 116 will contain more than 60% hydrogen, such as 70% hydrogen, 75% hydrogen, 80% hydrogen or more. This stream can be sent to any desired destnation. As one example, it may be cascaded to another process within the refinery. As another, it may be returned to the reformer reactors. This option may be useful, for example, in semi-regenerative reformer systems, where the hydrogen content of the membrane residue stream may be as high or higher than the reactor hydrogen concentration, at least during the latter part of the bed cycle. Most preferably, at least a portion of the stream is returned to the inlet side of the PSA unit for additional hydrogen recovery, as discussed with respect to FIGS. 2 and 3 below.

The membrane separation step also results in a permeate stream, 115, that is enriched in hydrocarbons compared with the membrane feed stream 113. Typically, this stream may contain up to 10% or more $C_{3+}$ hydrocarbons, such as 15% or more $C_{3+}$ hydrocarbons, and can be sent to any desired destination, such as directly to the plant fuel header, to further treatment, or to the saturated gas plant for splitting with other streams from the refinery into separate $C_2$–$C_5$ hydrocarbon fractions. The stream may also be of suitable composition to serve as feed to a steam reformer. Most preferably, particularly if it contains a high percentage of $C_{3+}$ hydrocarbons, such as above 10% hydrocarbons, stream 115 is recirculated to the compression/cooling step as discussed below with respect to FIGS. 2 and 3.

Figure 2:
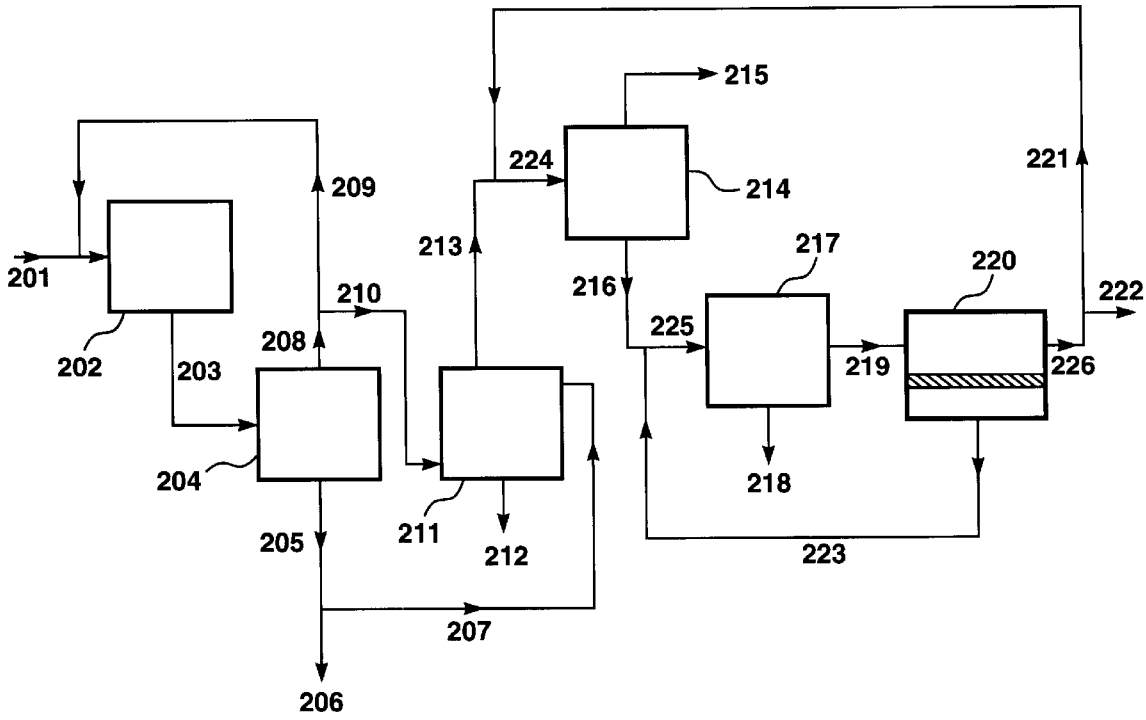
FIG. 2 is a schematic drawing showing a preferred embodiment of the invention including LPG production.

Turning to FIG. 2, this shows a preferred embodiment in which a recontacting step is included as part of the phase-separation step and in which a liquid hydrocarbon stream is recovered as an additional product. Referring to this figure, hydrocarbon charge, 201, and recycle stream, 209, are brought to the desired conditions and introduced into the reactor or reactors, 202. Effluent stream 203 is withdrawn and enters the first phase separation step 204. This can be executed in any convenient manner, as described for FIG. 1 above, but typically involves multistage cooling, such as down to a temperature below 100° C., to form liquid and vapor phases. The phases are separated in any suitable manner and liquid stream 205 of raw reformate is withdrawn. A portion of this unstabilized reformate is withdrawn as stream 206 and sent to fractionation or other treatment as known in the art. The remainder of the raw reformate, typically comprising up to about 50% of stream 205, is passed as stream 207 to recontactor, 211. Vapor phase 208 is withdrawn from the separator and divided into recycle stream 209, which is recompressed (not shown) as necessary and returned to the inlet side of the reactors, and stream 210, which is withdrawn from the reactor loop as shown. Stream 210 is introduced into recontactor 211.

The recontactor may be of any type known in the art, such as a single-stage contactor vessel or a trayed or packed absorption column. Within the contactor, the vapor stream and the unstabilized reformate are brought into equilibrating contact, resulting in transfer of $C_{3+}$ components from the vapor to the reformate. The recontactor is typically operated at elevated pressure, such as up to about 200 psia, 300 psia or 400 psia, so stream 210 may be compressed as desired before passing into the recontactor itself. The recontactor is also typically operated at low temperature, such as below 0° C., for example, about −10° C., −20° C. or below, to facilitate good capture of the $C_{3+}$ hydrocarbons into the liquid phase. Temperatures in this range can be reached by passing incoming streams 210 and 207 through heat exchangers against outgoing streams 212 and 213, plus external chilling, for simplicity none of which is shown in the figure.

The reformate phase is withdrawn as stream 212 and passed for further fractionation, stabilization, etc. as desired. The overhead gas from the recontactor, stream 213, typically contains at least about 80% hydrogen or more. This stream is mixed with membrane residue recycle stream 221 to form combined stream 224. Stream 224 is passed, optionally with additional compression, into PSA unit 214. High-purity hydrogen product stream 215 is withdrawn. Waste hydrocarbon stream 216, tail gas from one or more of the PSA regeneration cycles, is combined with membrane permeate stream 223 to form stream 225, which is passed to compression/cooling step 217, carried out in the manner described with respect to FIG. 1. In this preferred embodiment, however, the pressure and temperature conditions to which stream 225 is subjected result in the formation of a $C_{3+}$ hydrocarbon rich liquid phase, which is separated from the remaining gas phase and withdrawn as LPG product stream 218. The ability to generate this additional product stream from the PSA waste gas is a particular advantage of the invention in this embodiment.

The uncondensed gas, stream 219, leaves the compression/cooling step and passes to membrane separation step, 220. The membrane unit divides the vapor stream into permeate stream, 223, enriched in hydrocarbons and depleted in hydrogen, and residue stream 226, enriched in hydrogen and depleted in hydrocarbons. The permeate stream is recirculated to the inlet side of the compression/cooling step 218 as shown. Stream 226 is split, with residue stream 221 being recirculated as shown, after further compression if required, for treatment in the PSA unit and additional hydrogen recovery. Thus, this embodiment has the further benefit of producing more hydrogen from the PSA step than would be the case if the PSA tail gas were simply sent to the fuel line. To avoid build up of methane and/or other light contaminants in the process loops, a purge stream 222 is taken from stream 226 before it is returned to the PSA step. Stream 222 may typically be passed to the fuel line.

Figure 3:
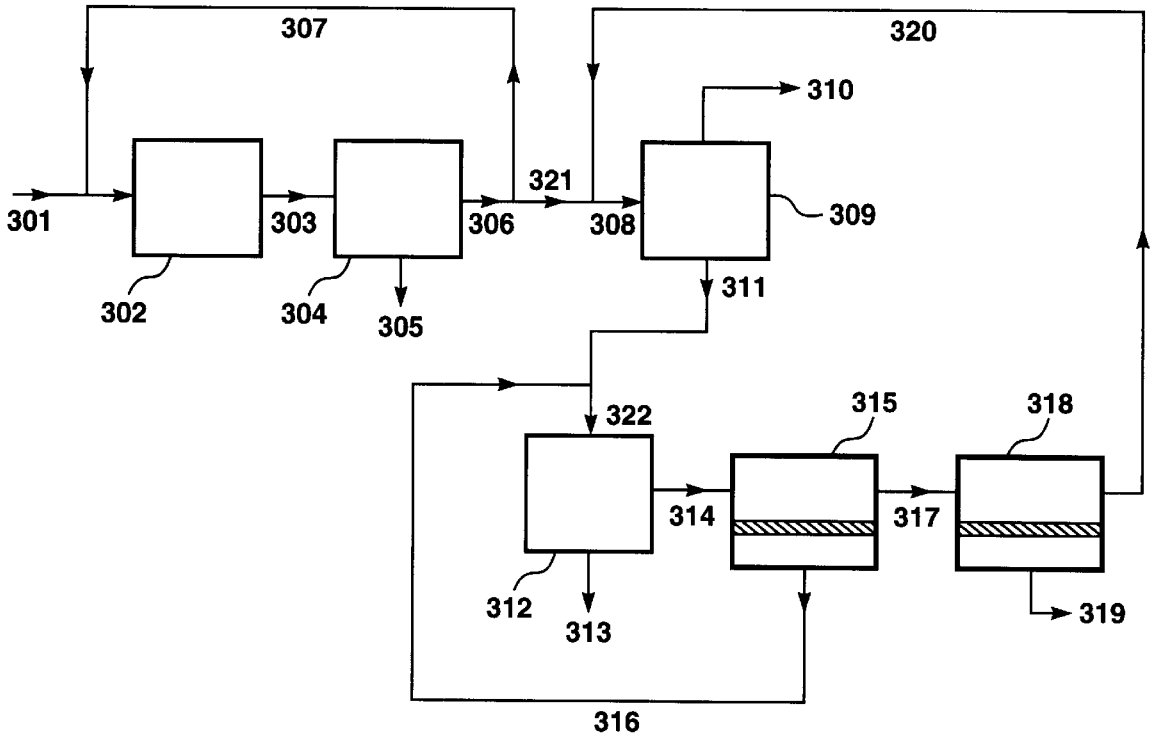
FIG. 3 is a schematic drawing showing a preferred embodiment of the invention in which an additional membrane step is used to provide selective purging of the lightest hydrocarbons.

Turning to FIG. 3, this shows another and particularly preferred embodiment in which a membrane purge step is used to provide selective purging of the lightest hydrocarbons. Referring to this figure, hydrocarbon charge, 301, and recycle stream, 307, are brought to the desired conditions and introduced into the reactor or reactors, 302. Effluent stream 303 is withdrawn and enters phase separation step 304, which may be configured in any manner as discussed above with respect to FIGS. 1 and 2. Liquid and vapor phases are separated and liquid reformate stream 305 is withdrawn. Vapor stream 306 is divided into stream 307, for recirculation of hydrogen in the reactor loop, and stream 321. Stream 321 is combined with hydrogen-enriched residue stream 320 to form stream 308, which is passed to and treated in PSA unit 309 to form high-purity hydrogen product stream 310. Waste hydrocarbon gas stream 311, from one or more of the regeneration cycles of the PSA beds, is combined with hydrogen-depleted permeate stream 316 to form stream 322. This combined stream passes to compression/cooling step 312, which is carried out under pressure/temperature conditions that give rise to liquefaction of a portion of the hydrocarbons. LPG stream 313, which is rich in $C_{3+}$ hydrocarbons, is withdrawn from the process.

The uncondensed gas, stream 314, leaves the compression/cooling step and passes to membrane separation step 315. The membrane unit divides the vapor stream into permeate stream 316, enriched in $C_{3+}$ hydrocarbons and depleted in hydrogen, and residue stream 317, enriched in hydrogen and depleted in hydrocarbons. The permeate stream is recirculated to the inlet side of the compression/cooling step.

Residue stream 317 is withdrawn from membrane unit 315. In this embodiment, as in FIG. 2, the process involves returning a portion of the hydrogen recovered from the PSA tail gas for additional recovery by the PSA unit, and purging a portion of the gas to control build up of methane or other light contaminants in the process loops. In this case, however, the purging is done by means of an additional membrane step, 318. The residue gas stream 317 remains at high pressure and low temperature, and can generally be fed directly to the feed side of the membrane purge unit of step 318. Optionally, additional compression or cooling can be provided. The choices of membrane materials and membranes for this unit are similar to those discussed above with respect to FIG. 1 for the main membrane unit. That is, rubbery membranes are preferred and silicone rubber membranes most preferred. Alternatively, glassy polymeric membranes that preferentially permeate the hydrogen and reject the hydrocarbons could be used for this purge step. These membranes are well known in the art and are currently in use for various hydrogen separation operations in refineries and elsewhere, such as those described in the background section above. These membranes are, however, not preferred because the hydrogen-enriched stream is then the low-pressure permeate stream, and requires recompression for return to the PSA unit. In preferred cases as shown in FIG. 3, the membrane purge step 318 produces a hydrogen-enriched, methane-depleted residue stream, 320, which is recirculated to the PSA step for additional hydrogen recovery, and a methane-enriched, hydrogen-depleted permeate stream, 319, which is purged from the process and typically sent to the fiel line. In this manner, the amount of unrecovered material is reduced still further compared with the embodiment of FIG. 2.

As will be appreciated by those of skill in the art, the membrane area and operating parameters of the membrane separation steps described with respect to FIGS. 1–3 above, can be varied to focus on specific targets, such as high LPG recovery, high hydrogen recovery, or low fuiel gas production. One particular benefit ofthe invention is that it provides control of the amount of fuel gas produced by the reforming operation. Prior art reforming trains that use a PSA or other unit to purify the excess hydrogen stream produced by the reforming reactors have generally sent the resulting hydrocarbon waste stream to the fuiel line. The process of the invention provides the ability to reduce the gas sent to the fuel line by 50% or more, compared with the case in which PSA alone is used to treat the net gas from the reactors, as shown in the Examples. A useful result is that some plants that were previously bottlenecked by fuel gas production are able to increase throughput in the reactors, thereby increasing product yield.

In another aspect, the invention is a catalytic reformer apparatus train, and FIGS. 1–3 show the elements of the apparatus in various embodiments. Referring again to FIG. 1, lines 101 and 107 form the feed stream inlet line carrying the raw hydrocarbon feedstock and the recycle hydrogen, respectively, to the reactor 102. The reactor is capable of carrying out the type of reforming reactions described, and has an effluent outlet line, 103, through which fluid can pass, either directly as shown or via some intermediate treatment, to the phase separator or separators, 104. The phase separator has a liquid outlet line, 105, and a vapor outlet line, 106. The vapor outlet line is connected, either directly as shown through feed side inlet line 108, or via intermediate equipment as appropriate, to treatment unit 109, preferably a PSA unit. Hydrogen product is withdrawn through line 110, and waste gases are withdrawn through line 111 and passed to compression/cooling unit 112, which is connected to the feed side of membrane separation unit, 114 through line 113. This unit contains membranes that are selective in favor of $C_1$–$C_6$ hydrocarbons over hydrogen, so as to produce a hydrocarbon-enriched permeate stream and a hydrocarbon-depleted, hydrogen-enriched residue stream. The membrane unit has a permeate side outlet line 115 and a residue, feed-side outlet line, 116.

Referring again to FIG. 2, lines 201 and 209 form the feed stream inlet line carrying the raw hydrocarbon feedstock and the recycle hydrogen, respectively, to the reactor 202. The reactor is capable of carrying out the type of reforming reactions described, and has an effluent outlet line, 203, through which fluid can pass, either directly as shown or via some intermediate treatment, to the phase separator or separators, 204. The phase separator has a liquid outlet line, 205, and a vapor outlet line, 208. The liquid outlet line divides into line 206, from which raw reformate can be withdrawn, and line 207, which connects to contactor 211. Similarly, line 208 divides into return line 209 and line 210, which connects with contactor 211. Line 212 provides for withdrawal of reformate from the contactor, and line 213 connects the contactor to selective adsorption unit 214. Line 215 provides for withdrawal of hydrogen from the unit; line 216 connects to compression/cooling unit 217. The compression/cooling unit is equipped with line 218 for removal of condensed liquids, and line 219, which connects to the feed side of membrane separation unit 220. This unit contains membranes that are selective in favor of $C_1$–$C_6$ hydrocarbons over hydrogen. The membrane unit has a permeate side outlet line 223, connected to the inlet of unit 217, and a residue, feed-side outlet line, 226, which connects via line 221 to the inlet of unit 214. Purge line 222 allows for removal of waste gas from the process.

Referring again to FIG. 3, lines 301 and 307 form the feed stream inlet line carrying the raw hydrocarbon feedstock and the recycle hydrogen, respectively, to the reactor 302. The reactor is capable of carrying out the type of reforming reactions described, and has an effluent outlet line, 303, through which fluid can pass, either directly as shown or via some intermediate treatment, to the phase separator or separators, 304. The phase separator has a liquid outlet line, 305, and a vapor outlet line, 306. The vapor outlet line is connected, either directly as shown through feed side inlet fine 308, or via intermediate equipment as appropriate, to treatment unit, 309, preferably a PSA unit. Hydrogen product is withdrawn through line 310, and waste gases are withdrawn through line 311 and passed to compression/cooling unit 312. The compression/cooling unit is equipped with line 313 for removal of condensed liquids, and line 314, which connects to the feed side of membrane separation unit 315. This unit contains membranes that are selective in favor of $C_1$–$C_6$ hydrocarbons over hydrogen. The membrane unit has a permeate side outlet line 316, connected to the inlet of unit 312, and a residue, feed-side outlet line, 317, connected to the feed side of membrane purge unit 318. Purge line 319 allows for removal of waste gas from the process. Line 320 is connected between the residue outlet of unit 318 and the inlet of unit 309.

For convenience, the invention has been described above as it relates to catalytic reforming. In this aspect, the invention basically involves a reforming step, a phase separation step, an adsorption step, and a treatment step, including membrane separation, for the tail gas from the adsorption step. It will be apparent to those of skill in the art that the invention, as it involves such a set of steps, is also of value for treating purge and vent streams from other sources in a refinery, including, but not limited to, mixed streams incorporating gases from catalytic reforming and other unit operations, gases from hydrocrackers, hydrotreaters, catalytic crackers, and so on. In a more general aspect, therefore, the invention comprises the following steps:

(a) reacting a hydrocarbon feedstock in a reactor system;

(b) withdrawing an effluent stream comprising hydrogen and hydrocarbons from the reactor system;

(c) separating a liquid phase and a vapor phase, comprising hydrogen and $C_1$–$C_6$ hydrocarbons, from the effluent stream;

(d) recirculating a portion of the vapor phase to the reactor system;

(e) passing at least a portion of the unrecirculated vapor phase through at least one treatment step, including an adsorption step carried out in an adsorption system, to separate hydrogen from the $C_1$–$C_6$ hydrocarbons;

(f) withdrawing a purified hydrogen product stream from the adsorption step;

(g) withdrawing a waste hydrocarbon stream from the adsorption system;

(h) compressing and cooling the waste hydrocarbon stream;

(i). passing at least a portion of the compressed, cooled waste hydrocarbon stream as a feed stream across the feed side of a polymeric membrane having a feed side and permeate side, and being selective for $C_1$–$C_6$ hydrocarbons over hydrogen;

(j) withdrawing from the feed side a residue stream enriched in hydrogen compared with the waste hydrocarbon stream;

(k) withdrawing from the permeate side a permeate stream enriched in $C_1$–$C_6$ hydrocarbons compared with the waste hydrocarbon stream.

Process step (a) may then include a hydrocracking process, a catalytic cracking process or any other process performed in a refinery environment that gives rise to hydrogen/hydrocarbon fluid mixtures.

It will also be appreciated by those of skill in the art that there may be circumstances where the compression/cooling step can be omitted, because the waste gas from the adsorption unit is at pressure, temperature and composition conditions that render it suitable for direct treatment in the membrane separation step. Alternatively, the compression/cooling step may be replaced by an absorption step, such as into a hydrocarbon sponge liquid, as is known in the art.

The invention is now further described by the following examples, which are intended to be illustrative of the invention, but are not intended to limit the scope or underlying principles in any way.

EXAMPLES

Example 1

A computer calculation was performed with a modeling program, ChemCad III (ChemStations, Inc., Houston, Tex.), to illustrate the process of the invention as reflected in the embodiment of FIG. 2.

The net gas from the phase separator/contactor section was assumed to be treated in a PSA unit operating at 390 psia, and the process was modeled only from the PSA treatment onward. After leaving the PSA unit, the tail gas was assumed to be compressed to 400 psia by two-stage compression and cooled to 2° C. by a combination of air cooling, heat exchange against the membrane feed stream, and external chilling. The membrane separation step was assumed to be carried out using a silicone rubber membrane in membrane unit 220. The contactor section off-gas stream was assumed to have the following composition:

Hydrogen 92.9%
Methane 1.8%
Ethane 1.7%
Propane 1.9%
Butanes 0.8%
Pentanes 0.1%
n-Hexane 0.7%

The results of the calculations are shown in Table 1. The stream numbers correspond to FIG. 2.

The process of the invention recovers over 9,000 lb/h of LPG as stream 218. In prior art processes using only PSA to treat the net gas from the contactor section, this product would have been lost in the tail gas from the PSA unit.

The process produces less than 3,000 lb/h of waste gas, to be sent to the fuel header or otherwise disposed of, compared with 10,000–15,000 lb/h that would be produced as tail gas in prior art processes using only PSA treatment. Thus, the process is very advantageous in debottlenecking plants where production is limited by fuel gas generation.

The process also provides a stream of about 2,800 lb/h (stream 221) containing over 600 lb/h of hydrogen to return to the PSA unit for additional recovery, leading to an increase of about 500 lb/h in hydrogen production compared with prior art processes.

Example 2

A computer calculation was performed as in Example 1, but with a different off-gas stream. In this case the gas entering the PSA unit was assumed to be a stream of mixed refinery purge and vent gases. The process design of FIG. 2 was assumed to be used. The gas stream was assumed to have a flow rate of about 31,000 lb/h (42 MMscfd), to be at a temperature of 38° C. and a pressure of 285 psia, and to have the following composition:

Hydrogen 82.0%
Nitrogen 1.0%
Methane 10.3%
Ethane 3.0%
Propane 1.3%
n-Butane 0.6%
n-Pentane 1.8%
Carbon Dioxide 0.1%

The results of the calculations are shown in Table 2. The stream numbers correspond to FIG. 2.

TABLE 1

| Stream | 213 | 224 | 215 | 216 | 225 | 218 | 219 | 223 | 226 | 221 | 222 |
|---|---|---|---|---|---|---|---|---|---|---|---|
| Flow (lbmol/h) | 4,131 | 4,541 | 3,526 | 1,015 | 3,112 | 194.3 | 2,918 | 2,098 | 819.6 | 409.8 | 409.8 |
| Mass flow (lb/h) | 19,313 | 22,082 | 7,126 | 14,956 | 52,825 | 9,395 | 43,430 | 37,869 | 5,538 | 2,769 | 2,769 |
| Temp.(° C.) | 44 | 40 | 40 | 40 | 10 | 2 | 2 | 0 | 0 | 0 | 0 |
| Pressure (psia) | 390 | 390 | 390 | 50 | 50 | 400 | 400 | 50 | 390 | 390 | 390 |
| Component (lb/h) | | | | | | | | | | | |
| Hydrogen | 7,737 | 8,359 | 7,105 | 1,254 | 3,114 | 8.9 | 3,105 | 1,860 | 1,245 | 622.4 | 622.4 |
| Methane | 1,216 | 2,330 | 11.6 | 2,319 | 7,370 | 87.8 | 7,282 | 5,051 | 2,229 | 1,114 | 1,114 |
| Ethane | 2,163 | 2,948 | 2.9 | 2,945 | 19,529 | 1,359 | 18,170 | 16,584 | 1,569 | 784.5 | 784.5 |
| Propane | 3,403 | 3,620 | 3.6 | 3,616 | 15,128 | 3,180 | 11,947 | 11,511 | 433.7 | 216.8 | 216.8 |
| Butanes | 1,988 | 2,018 | 2.0 | 2,016 | 4,490 | 1,957 | 2,534 | 2,475 | 58.5 | 29.3 | 29.3 |
| Pentanes | 400.2 | 401.6 | 0.4 | 401.3 | 570.5 | 398.5 | 172.0 | 169.2 | 2.7 | 1.3 | 1.3 |
| n-Hexane | 2,404 | 2,405 | 0.2 | 2,405 | 2,623 | 2,404 | 219.6 | 218.4 | 1.1 | 0.6 | 0.6 |
| Component (mol %): | | | | | | | | | | | |
| Hydrogen | 92.9 | 91.3 | 99.9 | 61.3 | 49.6 | 2.3 | 52.8 | 44.0 | 75.4 | 75.4 | 75.4 |
| Methane | 1.8 | 3.2 | — | 14.2 | 14.8 | 2.8 | 15.6 | 15.0 | 16.9 | 16.9 | 16.9 |
| Ethane | 1.7 | 2.2 | — | 9.6 | 20.9 | 23.3 | 20.7 | 26.3 | 6.4 | 6.4 | 6.4 |
| Propane | 1.9 | 1.8 | — | 8.1 | 11.0 | 37.1 | 9.3 | 12.4 | 1.2 | 1.2 | 1.2 |
| Butanes | 0.8 | 0.8 | — | 3.4 | 2.5 | 17.3 | 1.5 | 2.0 | 0.1 | 0.1 | 0.1 |
| Pentanes | 0.1 | 0.1 | — | 0.6 | 0.3 | 2.8 | 0.1 | 0.1 | — | — | — |
| n-Hexane | 0.7 | 0.6 | — | 2.8 | 1.0 | 14.4 | 0.1 | 0.1 | — | — | — |

— = less than 0.1
Membrane area = 1,470 $m^2$
Actual horsepower = 3,922 hp

TABLE 2

| Stream | 213 | 224 | 215 | 216 | 225 | 218 | 219 | 223 | 226 | 221 | 222 |
|---|---|---|---|---|---|---|---|---|---|---|---|
| Flow (lbmol/h) | 4,590 | 5,438 | 3,187 | 2,252 | 2,854 | 129.7 | 2,724 | 602.1 | 2,122 | 848.8 | 1,273 |
| Flow (lbmol/h) | 4,590 | 5,438 | 3,187 | 2,252 | 2,854 | 129.7 | 2,724 | 602.1 | 2,122 | 848.8 | 1,273 |
| Mass flow (lb/h) | 30,817 | 42,000 | 6,490 | 35,510 | 47,722 | 7,546 | 40,176 | 12,215 | 27,961 | 11,184 | 16,777 |
| Temp. (° C.) | 38 | 31 | 31 | 31 | 10 | 2 | 2 | −1 | −1 | −1 | −1 |
| Pressure (psia) | 285 | 285 | 285 | 50 | 50 | 295 | 295 | 50 | 285 | 285 | 285 |
| Component (lb/h) | | | | | | | | | | | |
| Hydrogen | 7,587 | 8,367 | 6,414 | 1,953 | 2,324 | 4.4 | 2,320 | 371.7 | 1,948 | 779.4 | 1,169 |
| Nitrogen | 1,157 | 1,925 | 0.0 | 1,925 | 2,124 | 3.7 | 2,121 | 199.2 | 1,921 | 768.6 | 1,153 |
| Methane | 7,607 | 12,563 | 76.5 | 12,487 | 15,595 | 96.1 | 15,499 | 3,108 | 12,391 | 4,956 | 7,425 |
| Ethane | 4,140 | 6,630 | 0.0 | 6,630 | 10,332 | 403.6 | 9,928 | 3,703 | 6,225 | 2,490 | 3,735 |
| Propane | 2,611 | 3,827 | 0.0 | 3,827 | 6,394 | 782.2 | 5,612 | 2,569 | 3,042 | 1,217 | 1,825 |
| n-Butane | 1,654 | 2,057 | 0.0 | 2,057 | 2,987 | 1,050 | 1,938 | 930.5 | 1,007 | 402.9 | 604.4 |
| n-Pentane | 5,961 | 6,466 | 0.0 | 6,466 | 7,691 | 5,202 | 2,489 | 1,225 | 1,264 | 505.7 | 758.5 |
| Carbon Dioxide | 101.0 | 165.3 | 0.0 | 165.3 | 273.3 | 4.4 | 268.8 | 107.9 | 160.9 | 64.4 | 96.5 |
| Component (mol %): | | | | | | | | | | | |
| Hydrogen | 82.0 | 76.3 | 99.9 | 43.0 | 40.4 | 1.7 | 42.3 | 30.6 | 45.5 | 45.5 | 45.5 |
| Nitrogen | 1.0 | 1.3 | 0.0 | 3.0 | 2.7 | 0.1 | 2.8 | 1.2 | 3.2 | 3.2 | 3.2 |
| Methane | 10.3 | 14.4 | 0.1 | 34.6 | 34.1 | 4.6 | 35.5 | 32.2 | 36.4 | 36.4 | 36.4 |
| Ethane | 3.0 | 4.1 | 0.0 | 9.8 | 12.0 | 10.3 | 12.1 | 20.5 | 9.8 | 9.8 | 9.8 |
| Propane | 1.3 | 1.6 | 0.0 | 3.9 | 5.1 | 13.7 | 4.7 | 9.7 | 3.3 | 3.3 | 3.3 |
| n-Butane | 0.6 | 0.7 | 0.0 | 1.6 | 1.8 | 13.9 | 1.2 | 2.7 | 0.8 | 0.8 | 0.8 |
| n-Pentane | 1.8 | 1.6 | 0.0 | 4.0 | 3.7 | 55.6 | 1.3 | 2.8 | 0.8 | 0.8 | 0.8 |
| Carbon Dioxide | 0.1 | 0.1 | 0.0 | 0.2 | 0.2 | 0.1 | 0.2 | 0.4 | 0.2 | 0.2 | 0.2 |

— = less than 0.1
Membrane area = 600 $m^2$
Actual horsepower = 3,279 hp

The process of the invention recovers approximately 7,500 lb/h of LPG as stream 218, and recycles a stream of about 11,000 lb/h (stream 221) containing nearly 800 lb/h of hydrogen to the PSA unit for further hydrogen recovery. The waste gas to the fuel header is about 17,000 lb/h, compared with about 20,000–25,000 lb/h that would be produced as tail gas in prior art processes using only PSA treatment.

Example 3

The calculation of Example 1 was repeated, using a design similar to FIG. 2, but without any recycle of the membrane residue, that is, all of hydrocarbon-depleted residue stream 226 is purged from the process. Thus, the goal in this case is to provide an LPG product stream and/or reduce fuel gas production, but without the need to maximize hydrogen recovery.

The results of the calculations are shown in Table 3. The stream numbers correspond to FIG. 2.

TABLE 3

| Stream | 213 | 215 | 216 | 225 | 218 | 219 | 223 | 222 |
|---|---|---|---|---|---|---|---|---|
| Flow (lbmol/h) | 4,131 | 3,263 | 867.7 | 2,499 | 179.3 | 2,320 | 1,632 | 688.7 |
| Mass flow (lb/h) | 19,313 | 6,591 | 12,722 | 39,805 | 8,913 | 30,892 | 27,083 | 3,820 |
| Temp. (° C.) | 44 | 44 | 44 | 10 | 2 | 2 | 2 | 2 |
| Pressure (psia) | 390 | 390 | 50 | 50 | 400 | 400 | 50 | 390 |
| Component (lb/h) | | | | | | | | |
| Hydrogen | 7,737 | 6,576 | 1,161 | 2,871 | 9.3 | 2,862 | 1,711 | 1,151 |
| Methane | 1,216 | 6.1 | 1,210 | 3,813 | 51.9 | 3,761 | 2,603 | 1,158 |
| Ethane | 2,163 | 2.2 | 2,161 | 13,377 | 1,080 | 12,297 | 11,216 | 1,091 |
| Propane | 3,403 | 3.4 | 3,400 | 12,605 | 3,035 | 9,570 | 9,205 | 364.5 |
| Butanes | 1,988 | 2.0 | 1,986 | 4,019 | 1,935 | 2,084 | 2,033 | 51.3 |
| Pentanes | 400.2 | 0.4 | 399.9 | 538.7 | 397.5 | 141.3 | 138.8 | 2.5 |
| n-Hexane | 2,404 | 0.2 | 2,404 | 2,580 | 2,403 | 176.6 | 175.6 | 1.0 |
| Component (mol %): | | | | | | | | |
| Hydrogen | 92.9 | 99.9 | 66.3 | 57.0 | 2.6 | 61.2 | 52.0 | 82.9 |
| Methane | 1.8 | — | 8.7 | 9.5 | 1.8 | 10.1 | 9.9 | 10.5 |
| Ethane | 1.7 | — | 8.3 | 17.8 | 20.0 | 17.6 | 22.9 | 5.3 |
| Propane | 1.9 | — | 8.9 | 11.4 | 38.4 | 9.4 | 12.8 | 1.2 |
| Butanes | 0.8 | — | 3.9 | 2.8 | 18.6 | 1.5 | 2.1 | 0.1 |

TABLE 3-continued

| Stream | 213 | 215 | 216 | 225 | 218 | 219 | 223 | 222 |
|---|---|---|---|---|---|---|---|---|
| Pentanes | 0.1 | — | 0.6 | 0.3 | 3.1 | 0.1 | 0.1 | — |
| n-Hexane | 0.7 | — | 3.2 | 1.2 | 15.6 | 0.1 | 0.1 | — |

— = less than 0.1
Membrane area = 1,199 $m^2$
Actual horsepower = 3,172 hp

The process of the invention recovers approximately 8,900 lb/h of LPG as stream 218. The purge stream sent to the fuel gas line is less than 4,000 lb/h, compared with nearly 13,000 lb/h if the entirety of PSA tail gas (stream 216) were purged.

Example 4

A computer calculation was performed to illustrate the use of a membrane selective purge to reduce hydrogen losses into the fuel gas/purge stream. The treatment process was assumed to be carried out according to the process design shown in FIG. 3, using a silicone rubber membrane in both membrane units. All other assumptions and parameters for the calculations were as in Example 1.

The results of the calculations are shown in Table 4. The stream numbers correspond to FIG. 3.

TABLE 4

| Stream | 321 | 308 | 310 | 311 | 322 | 313 | 314 | 316 | 317 | 319 | 320 |
|---|---|---|---|---|---|---|---|---|---|---|---|
| Flow (lbmol/h) | 4,131 | 4,597 | 3,582 | 1,015 | 3,073 | 183.7 | 2,889 | 2,059 | 829.7 | 363.4 | 466.0 |
| Mass flow (lb/h) | 19,313 | 21,783 | 7,240 | 14,542 | 50,693 | 9,029 | 41,663 | 36,150 | 5,487 | 3,017 | 2,470 |
| Temp. (° C.) | 44 | 39 | 39 | 39 | 10 | 2 | 2 | 1 | 1 | −2 | −2 |
| Pressure (psia) | 390 | 380 | 380 | 50 | 50 | 400 | 400 | 50 | 390 | 65 | 380 |
| Component (lb/h) | | | | | | | | | | | |
| Hydrogen | 7,737 | 8,494 | 7,220 | 1,274 | 3,162 | 8.6 | 3,153 | 1,888 | 1,265 | 508.6 | 756.8 |
| Methane | 1,216 | 2,422 | 12.1 | 2,410 | 7,647 | 86.4 | 7,561 | 5,237 | 2,316 | 1,111 | 1,207 |
| Ethane | 2,163 | 2,570 | 2.6 | 2,567 | 17,229 | 1,152 | 16,077 | 14,662 | 1,401 | 994.8 | 406.7 |
| Propane | 3,403 | 3,493 | 3.5 | 3,490 | 14,928 | 3,046 | 11,882 | 11,438 | 439.0 | 349.0 | 90.0 |
| Butanes | 1,988 | 1,998 | 2.0 | 1,997 | 4,525 | 1,935 | 2,589 | 2,527 | 61.3 | 50.6 | 10.7 |
| Pentanes | 400.2 | 400.8 | 0.4 | 400.4 | 574.0 | 397.4 | 176.6 | 173.6 | 2.9 | 2.5 | 0.4 |
| n-Hexane | 2,404 | 2,405 | 0.2 | 2,404 | 2,628 | 2,403 | 224.8 | 223.5 | 1.2 | 1.1 | 0.1 |
| Component (mol %) | | | | | | | | | | | |
| Hydrogen | 92.9 | 91.7 | 99.9 | 62.3 | 51.0 | 2.3 | 54.1 | 45.5 | 75.6 | 69.4 | 80.5 |
| Methane | 1.8 | 3.3 | — | 14.8 | 15.5 | 2.9 | 16.3 | 15.9 | 17.4 | 19.0 | 16.1 |
| Ethane | 1.7 | 1.9 | — | 8.4 | 18.6 | 20.9 | 18.5 | 23.7 | 5.6 | 9.1 | 2.9 |
| Propane | 1.9 | 1.7 | — | 7.8 | 11.0 | 37.6 | 9.3 | 12.6 | 1.2 | 2.2 | 0.4 |
| Butanes | 0.8 | 0.7 | — | 3.4 | 2.5 | 18.1 | 1.5 | 2.1 | 0.1 | 0.2 | — |
| Pentanes | 0.1 | 0.1 | — | 0.5 | 0.3 | 3.0 | 0.1 | 0.1 | — | — | — |
| n-Hexane | 0.7 | 0.6 | — | 2.7 | 1.0 | 15.2 | 0.1 | 0.1 | — | — | — |

— = less than 0.1
Membrane area = 1,473 $m^2$
Actual horsepower = 3,885 hp

Using the process of the invention to provide a selective purge, approximately 9,000 lb/h of LPG (stream 313) are recovered, and a stream of about 2,500 lb/h containing 750 lb/h of hydrogen (stream 320) is recycled to the PSA unit for further hydrogen recovery. The purge stream, 319, to the fuel gas line loses only 500 lb/h of hydrogen, compared with 600 lb/h of hydrogen in the embodiment of Example 1.

We claim:

1. A catalytic reforming process, comprising the following steps:

(a) catalytically reforming a hydrocarbon feedstock in a reactor system;

(b) withdrawing an effluent stream comprising hydrogen and hydrocarbons from the reactor system;

(c) separating a reformate liquid phase and a vapor phase, comprising hydrogen and $C_1$–$C_6$ hydrocarbons, from the effluent stream;

(d) recirculating a portion of the vapor phase of the the reactor system;

(e) passing at least a portion of the unrecirculated vapor phase through at least one treatment step, including an adsorption step carried out in an adsorption system, to separate hydrogen from the $C_1$–$C_6$ hydrocarbons;

(f) withdrawing a purified hydrogen product stream from the adsorption step;

(g) withdrawing a waste hydrocarbon stream from the adsorption system;

(h) compressing and cooling the waste hydrocarbon stream;

(i) passing at least a portion of the compressed, cooled waste hydrocarbon stream as a feed stream across the feed side of a polymeric membrane having a feed side and a permeate side, and being selective for $C_1$–$C_6$ hydrocarbons over hydrogen;

(j) withdrawing from the feed side a residue stream enriched in hydrogen compared with the waste hydrocarbon stream;

(k) withdrawing from the permeate side a permeate stream enriched in the $C_1$–$C_6$ hydrocarbons compared with the waste hydrocarbon stream.

2. The process of claim 1, wherein the reactor system is a semi-regenerative reactor system.

3. The process of claim 1, wherein the reactor system is a cyclic reactor system.

4. The process of claim 1, wherein the reactor system is a continuous catalyst regeneration reactor system.

5. The process of claim 1, wherein step (c) comprises cooling at least a portion of the effluent stream.

6. The process of claim 1, wherein step (c) comprises at least a cooling step and a recontacting step, and wherein the portion of the unrecirculated vapor phase referred to in step (e) is produced at least in part by the recontacting step.

7. The process of claim 1, wherein the adsorption system is a pressure swing adsorption system.

8. The process of claim 1, wherein step (h) raises the waste hydrocarbon gas stream to a pressure in the range 150–750 psia.

9. The process of claim 1, wherein step (h) lowers the temperature of the waste hydrocarbon stream to a temperature in the range of 20° C. to −40° C.

10. The process of claim 1, wherein the polymeric membrane comprises silicone rubber.

11. The process of claim 1, wherein the polymeric membrane comprises a super-glassy polymer.

12. The process of claim 1, wherein the permeate stream is subjected to further separation treatment.

13. The process of claim 1, wherein the permeate stream is sent to a fuel line.

14. The process of claim 1, wherein step (h) results in condensation of a liquid hydrocarbon fraction and wherein the liquid hydrocarbon fraction is removed from the feed stream prior to passing the feed stream across the feed side.

15. The process of claim 1, further comprising recirculating the permeate stream to step (h).

16. The process of claim 1, further comprising recirculating at least a portion of the residue stream to the adsorption step.

17. The process of claim 1, wherein at least a portion of the residue stream is withdrawn and used as a hydrogen source elsewhere.

18. The process of claim 1, further comprising subjecting at least a portion of the residue stream to a membrane separation step to separate methane from hydrogen.

19. The process of claim 1, further comprising subjecting at least a portion of the residue stream to a membrane purge step, thereby forming a hydrogen-enriched stream and a light-hydrocarbon-enriched stream, purging the light-hydrocarbon-enriched stream from the process, and recirculating at least a portion of the hydrogen-enriched stream to the adsorption step.

20. A catalytic reforming process, comprising the following steps:

(a) catalytically reforming a hydrocarbon feedstock in a reactor system;

(b) withdrawing an effluent stream comprising hydrogen and hydrocarbons from the reactor system;

(c) separating a raw reformate liquid phase and a vapor phase, comprising hydrogen and $C_1$–$C_6$ hydrocarbons, from the effluent stream;

(d) recirculating a portion of the vapor phase to the reactor system;

(e) passing at least a portion of the unrecirculated vapor phase and at least a portion of the raw reformate liquid phase into a contactor;

(f) withdrawing from the contactor a gas stream depleted in $C_{3+}$ hydrocarbon content compared with the unrecirculated vapor phase;

(g) passing at least a portion of the gas stream through an adsorption step carried out in an adsorption system, to separate hydrogen from the $C_1$–$C_6$ hydrocarbons;

(h) withdrawing a purified hydrogen product stream from the adsorption step;

(i) withdrawing a waste hydrocarbon stream from the adsorption system;

(j) compressing and cooling the waste hydrocarbon stream, thereby forming a condensate and an uncondensed portion;

(k) passing at least a portion of the uncondensed portion as a feed stream across the feed side of a polymeric membrane having a feed side and a permeate side, and being selective for the $C_1$–$C_6$ hydrocarbons over hydrogen;

(l) withdrawing from the feed side a residue stream enriched in hydrogen compared with the waste hydrocarbon stream;

(m) withdrawing from the permeate side a permeate stream enriched in the $C_1$–$C_6$ hydrocarbons compared with the waste hydrocarbon stream.

21. The process of claim 20, wherein the polymeric membrane comprises silicone rubber.

22. The process of claim 20, wherein the polymeric membrane comprises a super-glassy polymer.

23. The process of claim 20, further comprising recirculating the permeate stream to step (j).

24. The process of claim 20, further comprising recirculating at least a portion of the residue stream to the adsorption step.

25. The process of claim 20, wherein at least a portion of the residue stream is withdrawn and used as a hydrogen source elsewhere.

26. The process of claim 20, further comprising subjecting at least a portion of the residue stream to a membrane separation step to separate methane from hydrogen.

27. The process of claim 20, further comprising subjecting at least a portion of the residue stream to a membrane purge step, thereby forming a hydrogen-enriched stream and a light-hydrocarbon-enriched stream, purging the light-hydrocarbon-enriched stream from the process, and recirculating at least a portion of the hydrogen-enriched stream to the adsorption step.

28. A catalytic reforming process, comprising the following steps:

(a) catalytically reforming a hydrocarbon feedstock in a reactor system;

(b) withdrawing an effluent stream comprising hydrogen and hydrocarbons from the reactor system;

(c) separating a reformate liquid phase and a vapor phase, comprising hydrogen and $C_1$–$C_6$ hydrocarbons, from the effluent stream;

(d) recirculating a portion of the vapor phase to the reactor system;

(e) passing at least a portion of the unrecirculated vapor phase through at least one treatment step, including an adsorption step carried out in an adsorption system, to separate hydrogen from the $C_1$–$C_6$ hydrocarbons;

(f) withdrawing a purified hydrogen product stream from the adsorption step;

(g) withdrawing a waste hydrocarbon stream from the adsorption system;

(h) compressing and cooling the waste hydrocarbon stream;

(i) passing at least a portion of the compressed, cooled waste hydrocarbon stream as a feed stream across the feed side of a polymeric membrane having a feed side and a permeate side, and being selective for $C_1$–$C_6$ hydrocarbons over hydrogen;

(j) withdrawing from the permeate side a permeate stream enriched in the $C_1$–$C_6$ hydrocarbons compared with the waste hydrocarbon stream;

(k) withdrawing from the feed side a residue stream enriched in hydrogen compared with the waste hydrocarbon stream;

(l) subjecting at least a portion of the residue stream to a membrane purge step, thereby forming a hydrogen-enriched stream and a light-hydrocarbon-enriched stream;

(m) purging the light-hydrocarbon-enriched stream from the process;

(n) recirculating at least a portion of the hydrogen-enriched stream to the adsorption step.

29. The process of claim 28, wherein step (c) comprises at least a cooling step and a recontacting step, and wherein the portion of the unrecirculated vapor phase referred to in step (e) is produced at least in part by the recontacting step.

30. The process of claim 28, wherein the polymeric membrane comprises silicone rubber.

31. The process of claim 28, wherein the polymeric membrane comprises a super-glassy polymer.

32. The process of claim 28, wherein the permeate stream is subjected to further separation treatment.

33. The process of claim 28, wherein the permeate stream is sent to a fuel line.

34. The process of claim 28, wherein step (h) results in condensation of a liquid hydrocarbon fraction and wherein the liquid hydrocarbon fraction is removed from the feed stream prior to passing the feed stream across the feed side.

35. The process of claim 28, further comprising recirculating the permeate stream to step (h).

* * * * *